US005452062A

United States Patent [19]

Baldwin et al.

[11] Patent Number: 5,452,062

[45] Date of Patent: Sep. 19, 1995

[54] TABS PRINTING IN A PRINTER

[75] Inventors: LeRoy A. Baldwin, Rochester; Ray Naramore, Webster; Ermanno C. Petocchi, Rochester, all of N.Y.

[73] Assignee: Xerox Corporation, Stamford, Conn.

[21] Appl. No.: 220,312

[22] Filed: Mar. 28, 1994

[51] Int. Cl.[6] ..... G03G 21/00

[52] U.S. Cl. ..... 355/325; 355/309

[58] Field of Search ..... 355/325, 308, 309, 316, 355/317, 318, 319, 311, 321–323; 271/3, 226–227, 109, 113, 9, 242.3, 298, 182, 258

[56] References Cited

U.S. PATENT DOCUMENTS

| | | | |
|---|---|---|---|
| 3,949,979 | 4/1976 | Taylor et al. | 271/10 |
| 4,128,327 | 12/1978 | Sugiyama et al. . | |
| 4,247,193 | 1/1981 | Kaneko et al. | 355/316 |
| 4,337,935 | 7/1982 | Sawada et al. | 271/9 |
| 4,472,049 | 9/1984 | Honma et al. | 271/256 |
| 4,541,711 | 9/1985 | Takahashi | 355/316 |
| 4,563,082 | 1/1986 | Sato | 355/55 |
| 4,763,161 | 8/1988 | Forest et al. | 355/325 |
| 5,043,771 | 8/1991 | Shibata et al. | 355/317 |
| 5,197,726 | 3/1993 | Nogami | 271/110 |
| 5,245,397 | 9/1993 | Mahoney | 355/325 |
| 5,257,082 | 10/1993 | Kobayashi et al. | 355/325 |
| 5,272,511 | 12/1993 | Conrad et al. | 355/325 |

*Primary Examiner*—A. T. Grimley
*Assistant Examiner*—Thu A. Dang

[57] ABSTRACT

A printer for printing images from a photoconductor onto copy sheets and tab stock includes stalled roller registration nip in a copy sheet path. The printer has a special materials tray and a sheet feeder for feeding tab stock from the tray to the paper path. Dual sensors connected to an AND gate are positioned in line across the paper path downstream of the special materials feeder to sense the feeding of tab stock and send a signal to a controller which stops the sheer feed. Once a signal is received by the controller that an image is in a particular position on the photoconductor, the sheet feeder is started again by the controller with the roller registration nip operating at process speed as well. When standard copy sheets are fed from conventional paper trays, the stalled roller registration nip operates to stall and register copy the sheets before they are fed to the U photoconductor.

7 Claims, 3 Drawing Sheets

TABS PRINTING IN A PRINTER

BACKGROUND AND MATERIAL DISCLOSURE STATEMENT

This invention relates to a printer apparatus or the like, and more particularly, to printing on tab stock,i.e., heavy weight sheets having an irregular, protruding portion on one edge thereof, with such a printer.

Middle volume bands of printers/copiers require feeding of tab stock with the tab edge leading from the feeder and through the registration transport. This requirement introduces extra timing uncertainty from the copy sheet feeders, for example, friction retard feeders and is incompatible with machines using stalled roll deskew registration as shown, for example in U.S. Pat. No. 3,949,979 and 4,128,327. No provision is made in the systems of these patents for handling tab stock.

Accordingly, disclosed herein is a printer for printing copy sheets that includes a paper path and a transport for transporting sheets through the paper path; stalled nip registration for registering standard copy sheets; and a lead edge wait station for tab stock. Since the stalled nip cannot register the lead edge of tab stock, two sensors are positioned in line across the process direction of the paper path prior to the stalled nip. These sensors detect tab stock as a stepped signal and the sheet transport is turned off, i.e., the lead edge of the tab stock is held in a wait station prior to the stalled nip. Prior to the tab stock being fed forwards, the normally stalled registration nip is driven at constant process speed so as to behave as a regular paper drive nip.

The disclosed apparatus may be readily operated and controlled in a conventional manner with known or conventional copier or printer control systems, operated as taught herein. Some additional examples of various prior art copiers with document handlers and control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with known software instructions for known microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. As shown in the above-cited art, the control of exemplary document and copy sheet handling systems in copiers or printers may be accomplished by conventionally actuating them by signals from the copier controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc.. The operator inputs and controls, and machine internal controls or limits, may be coordinated and/or made interactive with operator displays and "prompts" or instructions. E.g., U.S. Pat. No 4,332,464 issued Jun. 1, 1982 re the Xerox Corporation "5700" printer. The resultant controller signals may conventionally actuate various conventional electrical solenoid or cam-control led sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of document and copy sheets as they are fed and circulated, keeping track of their general positions, counting the number of completed document set circulations and completed copies, etc. and thereby controlling the operation of the document and copy sheet feeders and inverters, etc.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example(s) below, as well as the claims. Thus, the present invention will be better understood from this description of an embodiment thereof, including the drawing figures (approximately to scale) wherein:

Describing now in further detail the exemplary embodiment with reference to the Figures, there is show a duplex printer reproducing machine 10 by way of one example of an apparatus in which the particular disclosed apparatus of the present invention may be utilized.

The following terms re the specific example here are hereby defined. "UI" is the User Interface, in this case the interactive CRT, or liquid crystal or other operator control console display panel and touch area or switch inputs connected to the system controller or ESS. It may also be called a UIT or User Interface Terminal. This 01 is where document handling, or finisher or other machine functions or modes are programmed in by the operator. The disclosed system can be used to determine, for example which of the five document handling modes (Recirculating Document Handler (RDH), (Semi-Automatic Document Handler (SADH), Computer Forms Feeder (CFF), Platen, and Book copying) the operator is trying to use for scanning. E.g., document scanning in Book Mode or CFF Mode are "selected" by the operator at the UIT in this example. ESS is the Electronic Sub-System or system control. IIT is the Image Input Terminal, also called a scanner in this example, but it does more than just image scan here. (Another term for this is EFE or Electronic Front End). IOT is the Image Output Terminal, which writes or prints (with a laser beam) the marks on the (copy) paper. DH is the overall Document Handler, or feeder, also referred to hereinbelow as the "UDH" or universal document handler with both an RDH document stacking tray input and a SADH/CFF document input into which either computer form web (usually fan-fold) feeding (CFF)or large or other individual documents may be loaded and fed.

Figure 1:
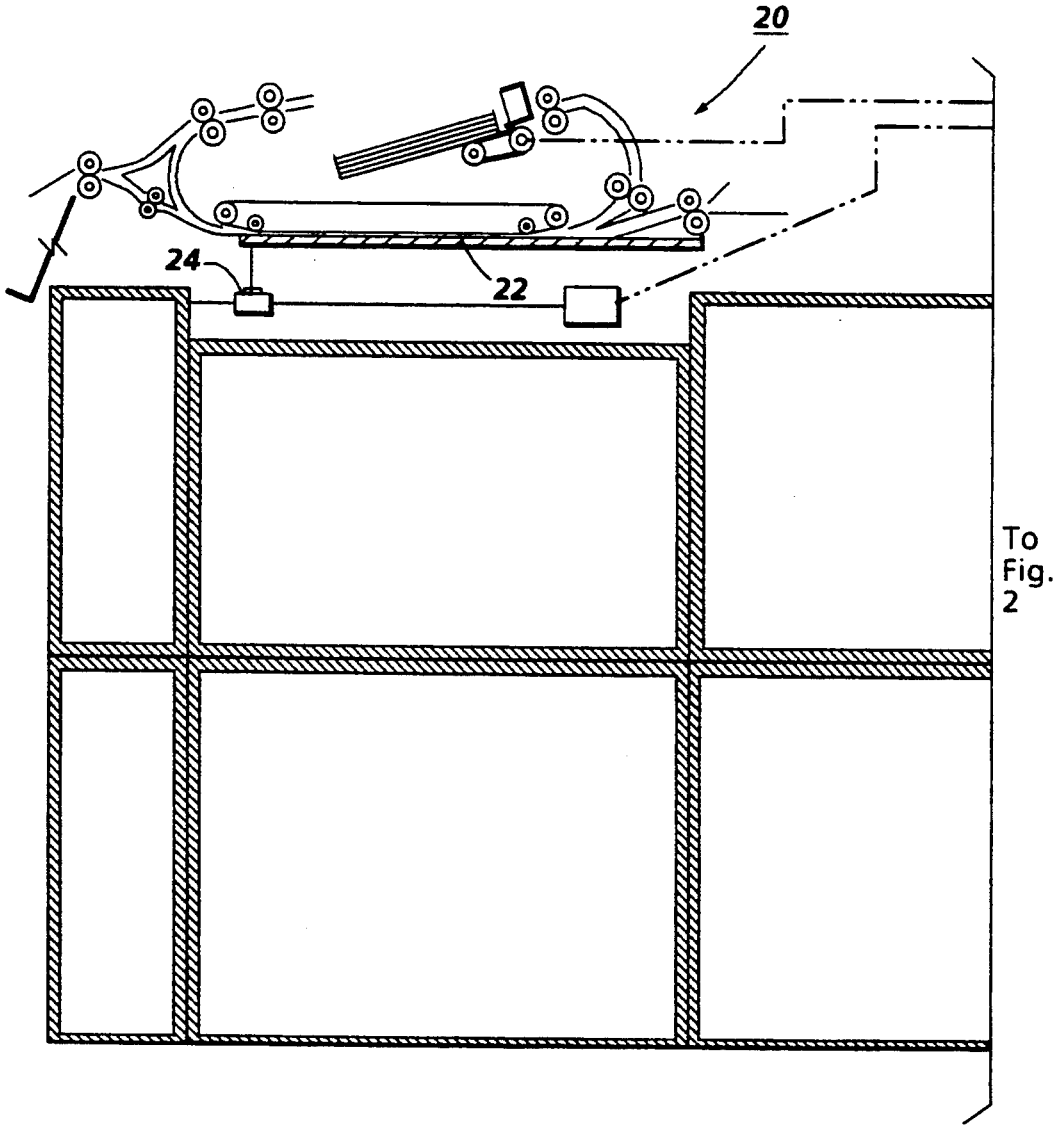
FIGS. 1 and 2 show a schematic partial side view of a conventional printer apparatus incorporating one example of the tab feeding system of the present invention.
Figure 2:
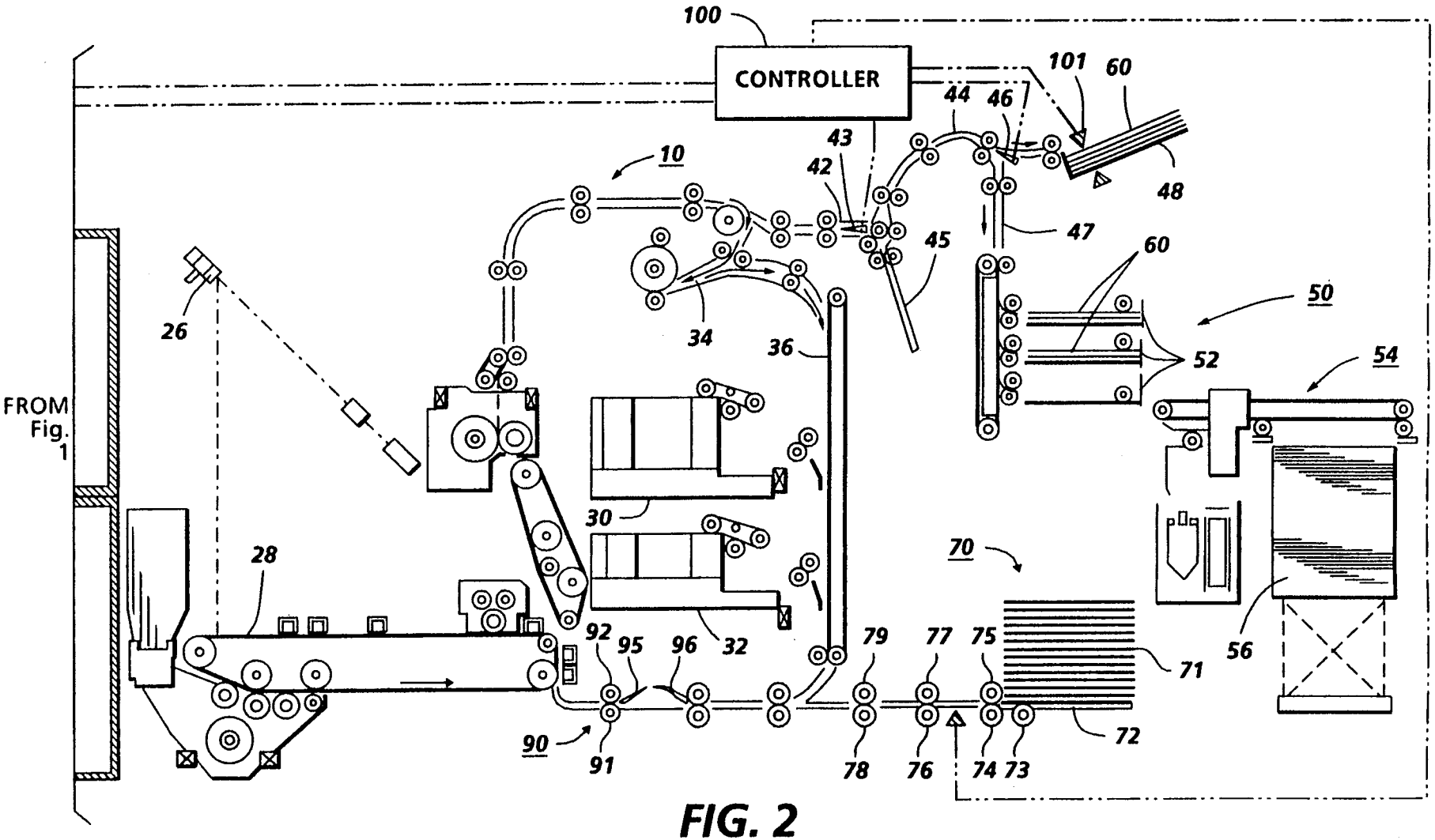

As disclosed in FIGS. 1 and 2, the printer 10 and its original document presentation system 20 in FIG. 1 may be like that disclosed in the above cited Xerox Corporation U.S. Pat. No. 4,782,363, issued Nov. 1, 1988 to J. E. Britt, et a. An electronic document imaging system 24, and a laser scanning system 26 imaging a photoreceptor 28, may be provided as shown here and in the above cross-referenced applications. Alternatively this may be a conventional optical imaging system. As discussed above, operator inputs and controls and machine internal controls and operator displays and "prompts" or instructions are provided in a controller 100 with displays. The document handler may also be like that in Xerox Corporation U.S. Pat. No. 4,579,444, and the finisher disclosed herein is like that shown and described in Xerox Corporation U.S. Pat. No. 4,782,363.

Here, in the printer 10 of FIG. 2, a generally conventional xerographic system example is shown, with clean paper trays 30 and 32 feeding unimaged copy sheets through a paper path to be imaged at the transfer area of engagement with the photoreceptor 28. Then the copy sheets are fused and outputted sequentially via path 42. Alternatively, for duplex (two-sided) copies, the copy sheets may be diverted to an inverter 34, and returned via path 36 for second side imaging before being outputted via path 42. In the output path 42 a selectable deflector gate 43 may be provided to invert the copy sheets via an inverter 45 if gate 43 is actuated. Then the copy sheets pass on via path 44 to an output station selection gate 46.

If the sheet deflector gate 46 is selected by the operator (via controller 100 inputs and software) to be up, as shown, all copy sheets 60 after that are deflected into a finisher path 47 to the finisher 50 compiler trays 52, from which the completed copy sets are removed 54 and bound or stapled and output stacked 56. Alternatively, if the gate 46 is selected by the operator to be down, then all outputting copy sheets after that are deflected into a readily accessible top tray 48. The presence or absence of any sheets in that top tray 48 is sensed by a conventional optical or flag sensor 101 conventionally connecting with the controller 100.

Figure 3:
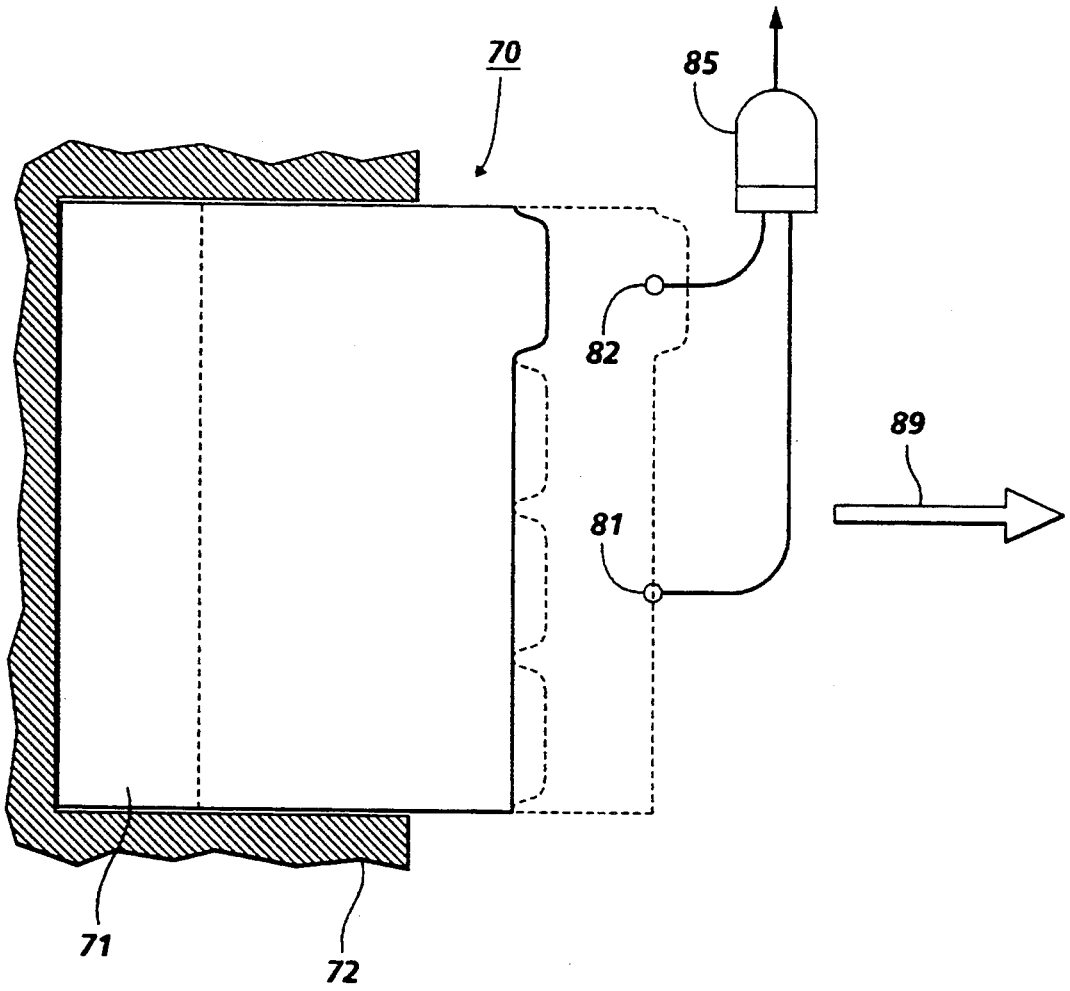
FIG. 3 is a partial plan view of the subject system of the present invention showing in line sensors for sensing tab stock.

Printer 10 in FIG. 2 addresses problems encountered by feeding tab stock 71 into the paper path of the printer from special stock feeder 70 in FIGS. 2 and 3. A nudger roller 73 forwards the bottommost tab sheet in the stack in the direction of arrow 89 to a sheet retard nip formed between retard roller 74 and feed roller 75. The retard nip also serves as a wait station for the tab stock. As is ordinary with retard roll feeders, feeding of multiple sheets of tab stock is prevented since retard roller 74 drives the double of a multifeed back into the stack while feed roller 75 feeds the other sheet into transport nips formed by drive rollers 77 and 79 and idler rollers 76 and 78, respectively. As shown in FIG. 3, lead edge wait station sensors 81 and 82 are positioned in line downstream of the retard nip and are connected to an AND gate 85. The wait station formed by retard roller 74 and feed roller 75 is enabled only when signals from both sensors are combined through AND gate 85 to give a transition signal which happens when both sensors are covered. The sensors are placed so that at least one of them will not see a tab. In this way the tab stock will be accurately stopped in the wait station, with respect to the non-tabbed lead edge of the sheet.

Ordinarily, copy sheets are fed from either tray 30 and 32 to a registration nip 90 formed by registration rollers 91 and 92. Registration roller 91 is driven by a motor not shown that is connected to Controller 100 and idler roller 92 is driven by drive roller 91 by being in contact therewith. In operation, a copy sheet is advanced into the registration nip and registration roller 91 is stopped by the Controller while transport roller continue to rotate in order to force the copy sheet to buckle into baffles 95 and 96 and wait a requisite time. Drive roller 91 is subsequently actuated to drive the copy sheet in timed relation to an image on photoconductor 28 such that the copy sheet resting in the registration nip is forwarded toward the photoconductor in synchronism with the image on the photoconductor. The detailed structure of a conventional registration control system is described in U.S. Pat. No. 3,902,715.

The registration nip 90 is adapted through Controller 100 to react differently when tab materials are fed from special materials handling tray 70 as seen in FIG. 3. When sheets with tabs are fed, the registration nip will run at constant process speed and the feed from wait station 74,75 will be the primary paper reference. The two in line sensors 81 and 82 detect the feeding of the tab stock as a stepped signal and through AND gate 85*a* signal is sent to Controller 100 to turned OFF the sheet transport including the retard roll nip formed by rollers 74 and 75 which now serves as a wait station for the sheet being fed. When a signal is sent by the Controller to drive the sheet in timed relation to an image on photoconductor 28 such that the tab sheet resting in the retard nip is forwarded by the transport rollers toward the photoconductor 28 in synchronism with the image on the photoconductor. As this is taking place, the normally stalled registration nip 90 too is driven the same as the transport rollers at constant process speed and if effect acts as a transport roller in this second mode of operation. While this scheme will result in slight degradation in the sheet-to-image (x, y, and skew) registration, the tradeoff is acceptable since it adds an important performance feature for minimum cost and zero impact to base machine cost and functionality.

It should now be apparent that a system has been disclosed for use in a copier/printer for printing copy sheets with the copier/printer including a paper path and a transport for transporting sheets through the paper path. Stalled nip registration rollers are used for registering standard copy sheets and a lead edge wait station is included for use with tab stock. Since the stalled nip cannot register the lead edge of tab stock, two sensors are positioned in line across the process direction of the paper path prior to the stalled nip. These sensors detect tab stock as a stepped signal and the sheet transport is turned off, i.e., the lead edge of the tab stock is held in a wait station (retard roller nip) prior to the stalled roller nip. The wait station servers the function of the stalled roller registration nip and is actuated by the Controller in timed relation to an image of the photoconductor in order to feed the tab in synchronism with the image. In this mode of operation of the device, the registration roller nip is rotated at the same speed as the sheet transport rollers and performs the same function.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In printer for printing copy sheets and tab stock, with a copy sheet path and a photoconductor, said copy sheet path including transport rollers and a stalled roller registration nip for registering copy sheets and subsequently feeding them in synchronism with an image on the photoconductor, the improvement comprising:

a special sheet materials feed tray for holding tab stock;

a retard roller nip for feeding sheet materials from said feed tray;

at least two sensors positioned in line and orthogonal to the feed direction of said copy sheet path and upstream of said stalled roller registration nip and adapted to send a signal when a sheet of tab material has been fed;

a controller for controlling the functioning of said stalled roller registration nip and said retard roller nip once a signal is received from said at least two sensors such that said registration roller nip and said retard roller nip are stopped and subsequently started in order for the sheet of tab material to be in synchronism with an image of said photoconductor with said registration roller nip rotating at the same speed as said transport rollers.

2. The printer of claim 1, including an AND gate, and wherein said at least two sensors are connected through said AND gate to said controller and adapted to give off a signal only when both sensors are covered by sheet material.

3. The printer of claim 2, wherein said stalled roller registration nip is adapted to stall and register sheets in said registration nip in first mode of operation and not stall and rotate at the speed of transport rollers in a second mode of operation.

4. The printer of claim 3, wherein said at least two sensors are positioned closely adjacent to and downstream of said retard roller nip.

5. A system for feeding a sheet of tab stock and non tab stock materials into a paper path in synchronism with an image on a photoconductor of a copier/printer, comprising:

a feed tray;

a feeder for feeding individual sheets of tab stock material from said feed tray;

a retard roller pair forming a nip for preventing multifeeds of tab stock material;

a pair of sensors positioned in line and orthogonal to the feed direction of said paper path and downstream of said retard roller nip, said sensors being adapted such that a signal is given off only when both sensors are covered by a sheet of the tab stock material;

a dual mode, stalled roller registration pair adapted in a first mode to stall and register individual non tab stock materials and in a second mode to not stall and function as a transport roller to forward individual sheets of tab stock material to said photoconductor; and a controller adapted to stop rotation of said retard roller pair and said stalled roller registration pair upon receipt of a signal from said pair of sensors when a sheet of tab stock material is being forwarded by said retard roller pair, and subsequently restart said retard roller pair and said stalled roller registration pair in order to feed the sheet of tab stock material in synchronism with an image on said photoconductor.

6. The printer of claim 5, including an AND gate, and wherein said at least two sensors are connected through said AND gate to said controller and adapted to give off a signal only when both sensors are covered by sheet material.

7. The printer of claim 6, wherein said at least two sensors are positioned closely adjacent to and downstream of said retard roller nip.

* * * * *